United States Patent [19]

Steffes et al.

[11] Patent Number: 5,042,081

[45] Date of Patent: Aug. 20, 1991

[54] ELECTRICAL THERMAL STORAGE HEATING UNIT WITH EASILY REPLACED HEATING

[75] Inventors: Paul J. Steffes; Brian A. Fosaaen; Thomas P. Steffes, all of Dickinson, N. Dak.

[73] Assignee: Steffes Manufacturing, Inc., Dickinson, N. Dak.

[21] Appl. No.: 453,229

[22] Filed: Dec. 14, 1989

Related U.S. Application Data

[63] Continuation of Ser. No. 124,600, Nov. 24, 1989, abandoned.

[51] Int. Cl.[5] ..... H05B 1/02; F24H 7/02

[52] U.S. Cl. ..... 392/344; 392/360

[58] Field of Search ..... 219/365, 378, 364, 341, 219/342; 392/339, 340, 341, 342, 343, 344, 346, 360, 365

[56] References Cited

U.S. PATENT DOCUMENTS

| | | | |
|---|---|---|---|
| 3,530,277 | 9/1970 | Kujansuu | 219/365 |
| 4,170,729 | 10/1979 | Lane | 219/378 X |
| 4,213,032 | 7/1980 | Olsen et al. | 219/378 |

FOREIGN PATENT DOCUMENTS

| | | | |
|---|---|---|---|
| 268469 | 2/1969 | Austria | 219/378 |
| 77993 | 5/1983 | European Pat. Off. | 219/378 |
| 2040564 | 2/1972 | Fed. Rep. of Germany | 219/378 |
| 3304511 | 8/1984 | Fed. Rep. of Germany | 219/378 |
| 981713 | 1/1965 | United Kingdom | 219/364 |
| 1026245 | 4/1966 | United Kingdom | 219/378 |

OTHER PUBLICATIONS

Electric Storage Heating, Instructions for Installation and Operation, American TechnoTherm; Winooski, Vt.

Electric Thermal Storage Heating, American TechnoTherm, Winooski, Vt.

Electric Storage Heating System, Emerson Electric Co., St. Louis, Mo.

Electric Thermal Storage Room Package Unit, Fostoria Industries, Inc.; Fostoria, Ohio, Installation and Service Manual.

Electric Storage Heaters, Installation and Operating Manual, Stiebel Eltron.

Electric Thermal Storage Heat, Stiebel Eltron.

*Primary Examiner*—Anthony Bartis

*Attorney, Agent, or Firm*—Merchant, Gould, Smith, Edell, Welter & Schmidt

[57] ABSTRACT

An electric thermal storage heating unit including (i) an insulated housing defining a storage chamber with two laterally extending linear openings through the base of the storage chamber, (ii) a plurality of heat-sink bricks within the storage chamber which define separate vertical ducts above each of the lateral linear openings, and (iii) a pair of substantially planar, serpentine electrical heating elements each defining an uppermost portion with parallel upper right and upper left sides and a lowermost portion with parallel lower right and lower left sides wherein the uppermost portion is angled with respect to the lowermost portion within the plane defined by the element so as to cause the right and left sides of the lowermost portion to extend at an obtuse angle of less than 180° with respect to the corresponding right and left sides of the uppermost portion and thereby facilitate insertion and removal of the heating elements through the linear opening and into the vertical ducts with minimal clearance.

18 Claims, 3 Drawing Sheets

FIG. 3
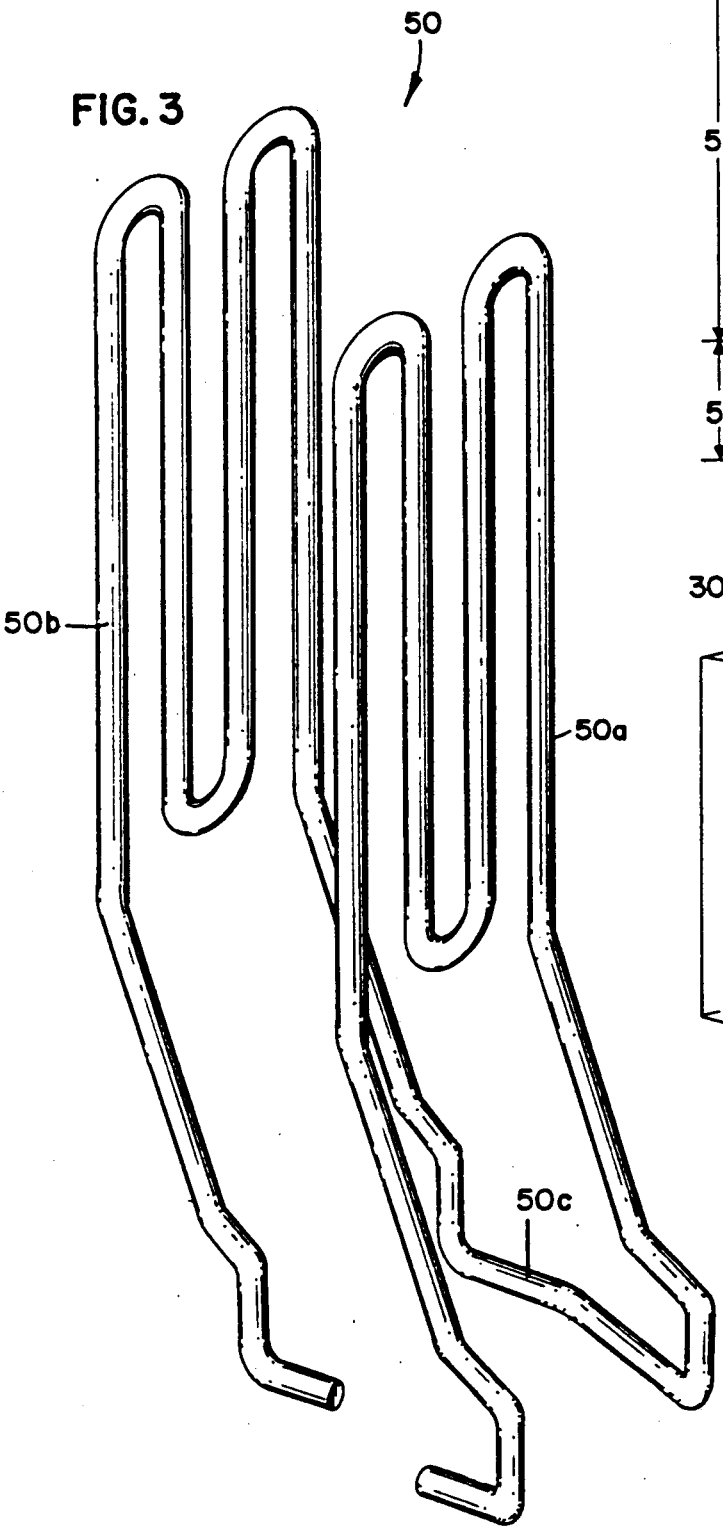
FIG. 4
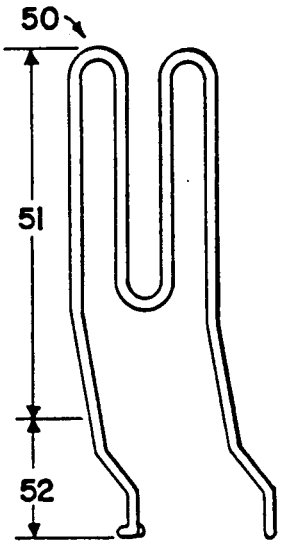
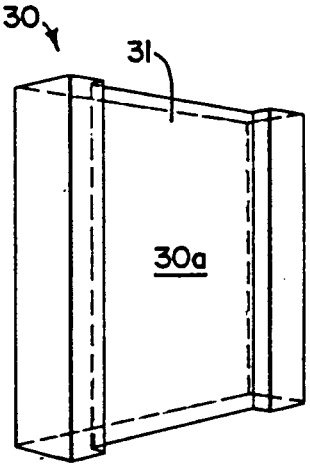
FIG. 5

ELECTRICAL THERMAL STORAGE HEATING UNIT WITH EASILY REPLACED HEATING

This is a continuation, of application Ser. No. 07/124,600, filed Nov. 24, 1989, now abandoned.

FIELD OF THE INVENTION

The invention relates broadly to space heaters. More specifically, the invention relates to electric thermal storage space heaters.

BACKGROUND OF THE INVENTION

Electric space heaters, because of their safety and convenience, are a popular means of heating commercial and residential living space. One type of electric space heater recently introduced into the market is the electrical thermal storage (ETS) heating unit. ETS heating units are particularly useful when the cost of electricity varies during the day (off-peak rates) because they can generate and store heat when the cost of electricity is low and use the stored, low-cost heat when the cost of electricity is high.

Typical ETS heaters include a heat sink surrounded by an insulated housing; at least one duct through the heat sink and housing for allowing surrounding air to be circulated past and heated by the heat sink; an electric heating element within the housing for generating heat; a fan for circulating air through the ducts; a thermostat for measuring the temperature of the space to be heated and controlling operation of the fan accordingly; and a thermostat for measuring the temperature of the heat sink and controlling the amount of heat stored in the heat sink by controlling operation of the heating element. While the heating unit requires a thermostat to measure room temperature in order to properly control the operation of the fan, these thermostats are typically not supplied by the manufacturer but are readily available to the consumer at many retail outlets.

Normal wear and tear of typical ETS heaters requires that the heating elements be periodically replaced. Unfortunately, the heating elements in typical ETS heaters are placed within the heat sink and the housing such that in order to replace the heating elements it is necessary to remove a portion of the housing, a portion of the insulation, and all or a portion of the heat sink; making the repair of worn heating elements in typical ETS heaters difficult and time consuming. Further, each time the insulation is disturbed in order to repair the heating elements the integrity of the insulation is destroyed and its insulating value decreased.

Accordingly, a need exists for an ETS heater designed to allow worn heating elements to be quickly and easily replaced without adversely affecting the integrity of the insulation.

SUMMARY OF THE INVENTION

The invention is directed to an electric thermal storage (ETS) heating unit which allows the heating elements to be quickly and easily replaced with minimal disturbance of the other components. The ETS heating unit includes an insulated housing having at least one laterally extending linear opening at the bottom thereof and defining a storage chamber. The housing is supported to provide sufficient clearance underneath so as to permit a heating element to be inserted or removed through the bottom of the housing. A plurality of heat sink bricks are configured within the storage chamber so as to form vertical ducts which extend substantially vertically above the laterally extending linear openings. The bricks also form horizontal ducts which interconnect the vertical ducts so that air external to the storage chamber can be drawn into a first vertical duct, circulated past the heat sink bricks, and returned external to the chamber through a second vertical duct.

The unit includes at least one substantially planar, serpentine, electrical heating element having a heat-generating portion extending into a vertical duct and a connecting portion extending out of the storage chamber through the linear opening. The heat generating portion of the heating element defines an uppermost portion with parallel upper right and upper left sides and a lowermost portion with parallel lower right and lower left sides wherein the uppermost portion is angled with respect to the lowermost portion within the plane defined by the element so as to cause the right and left sides of the lowermost portion to extend at an obtuse angle of less than 180° with respect to the corresponding right and left sides of the uppermost portion and thereby facilitate insertion and removal of the heating elements through the linear opening in the bottom of the unit. The heat generating portion of the heating element lies within substantially the same plane as the linear opening.

The unit employs a means for circulating air through the ducts which is in electrical communication with a temperature control means for measuring the temperature of the space to be heated by the unit and controlling the circulation of air through the ducts in relation to the air temperature. In order to control the amount of heat retained within the unit, the unit includes a means for measuring the temperature in the storage chamber and controlling the flow of electricity to the heating element in relation to the storage chamber temperature.

The heating elements may be quickly and easily replaced by electrically disconnecting the heating elements, slipping the heating elements out of the storage chamber through the linear opening, a slipping a new heating element into the storage chamber through the linear opening, and electrically reconnecting the new heating elements. It may be necessary to remove components below the housing such as the grill, the intake vent, etc. in order to remove the heating elements, but it is not necessary to disturb either the housing or the heat sink bricks.

DESCRIPTION OF THE DRAWINGS

FIG. 3 is a perspective view of two coupled heating elements from the ETS heating unit of in FIG. 1.

FIG. 4 is a front view of the two heating elements of FIG. 3.

FIG. 5 is a perspective view of a heat-sink brick from the ETS heating unit of FIG. 1.

DETAILED DESCRIPTION OF THE INVENTION INCLUDING A BEST MODE

Figure 2:
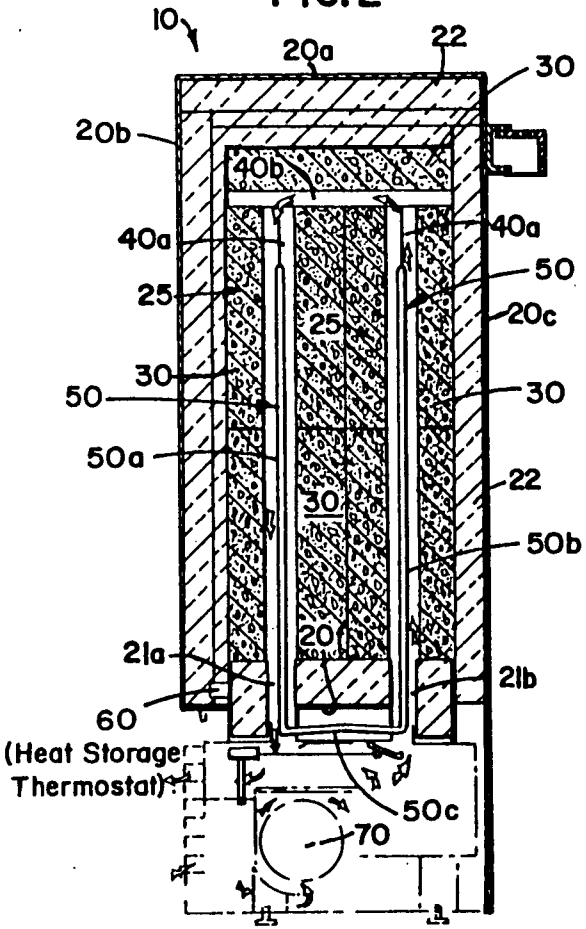
FIG. 2 is a sectional side view of the ETS heating unit of FIG. 1 with portions thereof removed.

The electric thermal storage (ETS) space heating unit 10 converts electricity to heat which can be either immediately employed for space heating or stored within the heating unit until needed.

The ETS heating unit 10 includes an insulated housing 20 having a top 20*a*, a front 20*b*, a back 20*c*, a right side (not shown), a left side 20*e*, and a bottom 20*f*. The bottom 20*f* of housing 20 has at least one, preferably two, parallel, laterally extending linear openings 21*a*, 21*b* extending from the right side (not shown) to the left side 20*e* of housing 20. Housing 20 defines a storage chamber 25 within which the heat generated by the unit 10 is created and stored.

A plurality of substantially rectangular, heat-sink bricks 30 are configured within storage chamber 25 so as to form vertical ducts 40*a* which extend substantially vertically above the laterally extending linear openings 21*a*, 21*b* and horizontal ducts 40*b* which connect to vertical ducts 40*a* at the top. Air may then circulate through the storage chamber 25 by flowing up one vertical duct 40*a*, across horizontal duct 40*b* and down another vertical duct 40*a*. The ducts 40*a*, 40*b* are preferably formed by substantially linear channels 31 which extend along the entire length of a first side 30*a* of each brick 30. To form vertical ducts 40*a* bricks 30 are configured first side 30*a* to first side 30*a* such that the channels 31 extend in the same direction and each channel 31 forms one-half of the vertical duct 40*a*.

A substantially planar, serpentine electrical heating element 50 is placed within at least one and preferably all vertical ducts 40*a*. As shown in FIG. 4, the heating elements 50 have an upper, heat-generating portion 51 extending into the vertical ducts 40*a* and a lower, connecting portion 52 extending out of storage chamber 25 through linear openings 21*a*, 21*b*. The upper portion 51 of each heating element 50 lies within substantially the same plane as the linear opening 21*a*, 21*b* through which it extends, such that the heating element 50 may be inserted into and removed from the storage chamber 25 through the linear opening 21*a*, 21*b* without disturbing the bricks 30 or the housing 20.

The heating elements 50 are preferably angled to one side along the plane defined by the upper portion 51 of the heating element 50 and the linear opening 21*a*, 21*b* through which the heating element 50 passes, so as to aid in removing and inserting the heating elements 50 with minimal clearance.

Figure 1:
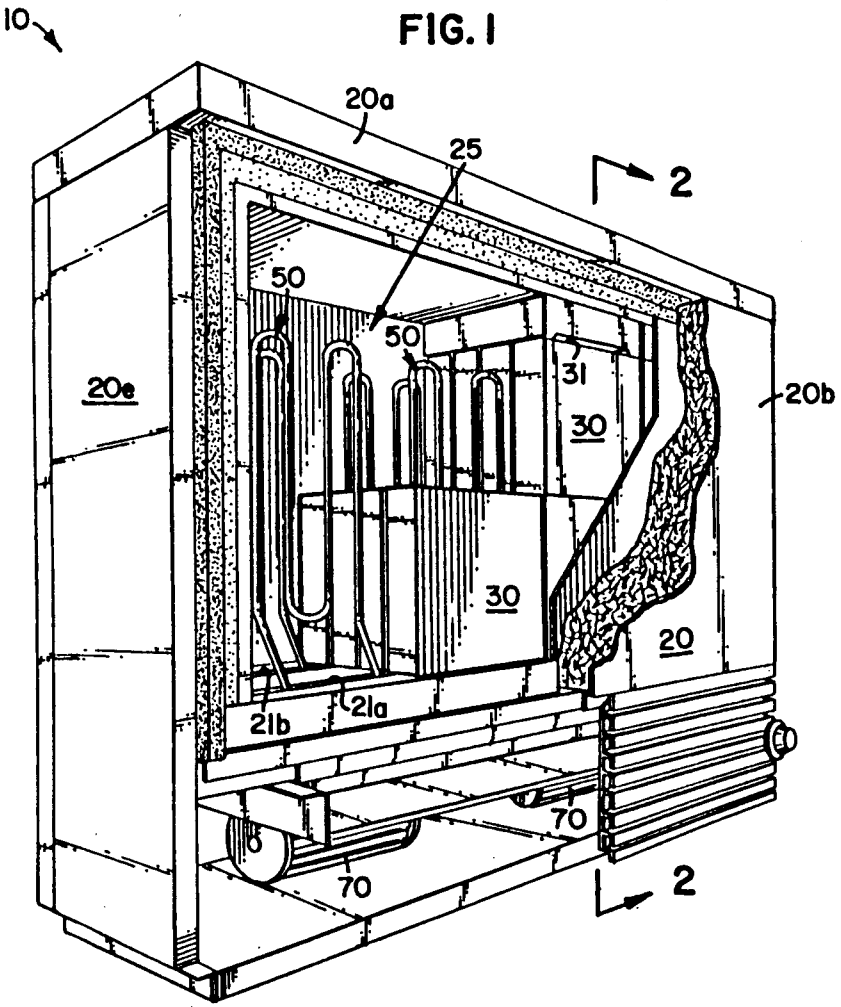
FIG. 1 is a perspective view of one embodiment of the ETS heating unit with portions thereof removed.

Referring specifically to FIGS. 1 and 2; preferably, the housing 20 has two, substantially parallel, linear, laterally extending openings (a front opening 21*a* and a back opening 21*b*) opening 21*b* and integrally paired heating elements 50; a front element 50*a*, and a back element 50*b*, connected by a portion 50*c* such that they must be removed from and inserted into the storage chamber 25 as a single unit.

The vertical ducts 40*a* and upper portion 51 of heating elements 50 are sized and configured such that the heating elements 50 may occupy the vertical ducts 40*a* without significantly impeding air flow through the ducts 40.

The heating elements 50 are electrically interconnected by any suitable means and can be designed to receive electrical current from any typical source of electricity. Preferably the unit 10 is hard wired.

Figure 7:
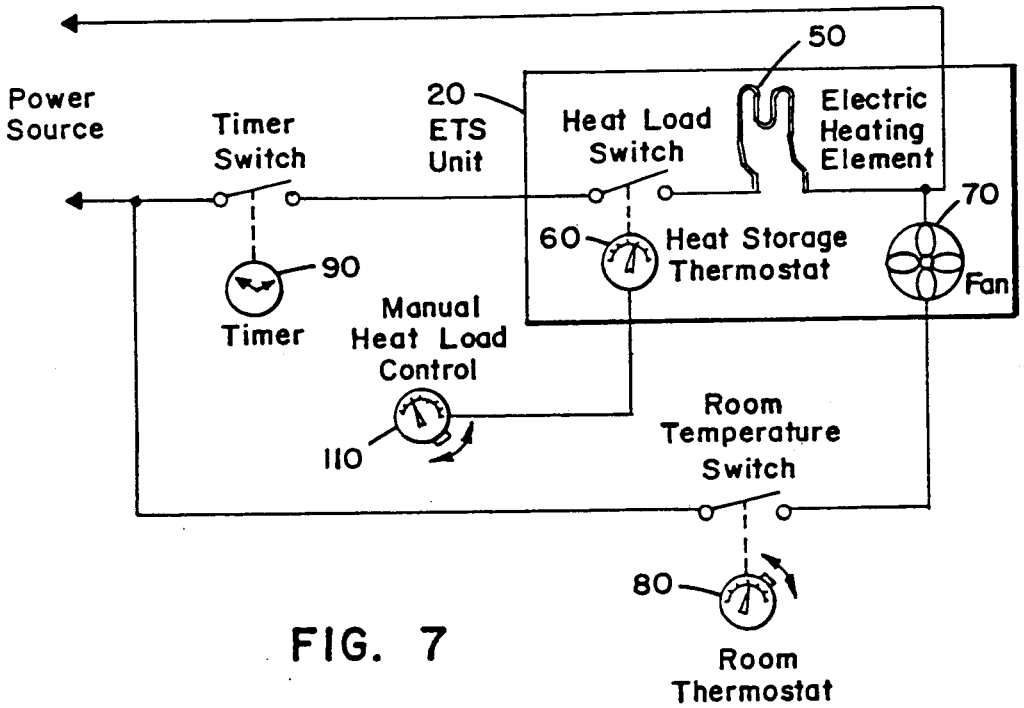
FIG. 7 is an electrical schematic diagram of the invention's electrical system providing for manual adjustment of the heat load control means.

Referring generally to FIG. 7, the heating elements 50 are electrically coupled to a heat-load control means such as a combination heat load switch and heat storage thermostat 60 which measures the temperature in the storage chamber 25 and generates a signal in relation to the temperature in the storage chamber 25. The heat storage thermostat 60 generates a primary signal after the temperature in the storage chamber 25 falls below a predetermined minimum and generates a secondary signal after the temperature in the storage chamber 25 rises above a predetermined maximum. The heat storage thermostat 60 allows electricity to flow to the heating elements 50 when the primary signal is being generated and prevents the flow of electricity to the heating elements 50 when the secondary signal is being generated. Accordingly, the heating elements 50 receive electricity and generate heat when the temperature within the storage chamber 25 falls below the predetermined minimum and prevents heating elements 50 from receiving electricity and generating heat when the temperature within the storage chamber 25 rises above the predetermined maximum so as to prevent the heating unit 10 from overheating.

The minimum and maximum temperatures of the heat storage thermostat 60 can be varied so as to allow the amount of heat stored in the heating unit 10 to be varied based upon demand. Such variance of the minimum and maximum temperature settings of the heat load control means 60 can be made either manually by means of a manually operated control such as a manual heat load control 110 or automatically by means of a remote thermostat 100 such as an outside temperature sensor which measures the outside temperature.

A pair of fans 70 circulates cool air from the space to be heated, through the ducts 40*a*, 40*b* and back out into the space to be heated.

Figure 6:
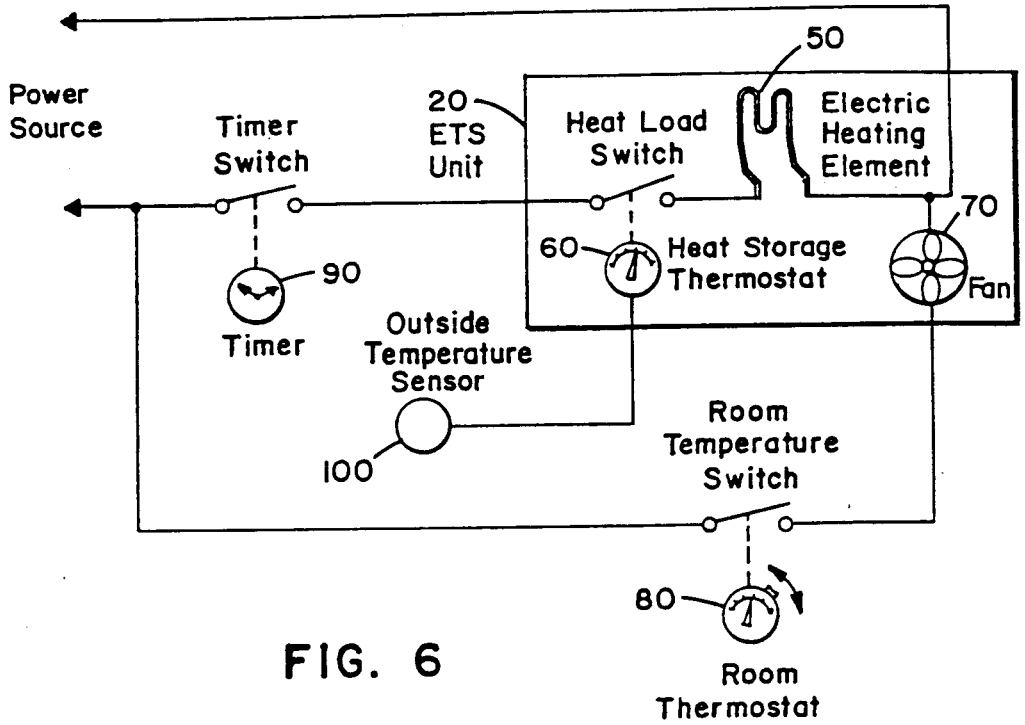
FIG. 6 is an electrical schematic diagram of the invention's electrical system providing for automatic adjustment of the heat load control means.

Referring generally to FIG. 6, operation of 70 is controlled by a temperature control means such as a room thermostat 80 which measures the temperature of the space to be heated and operates the 70 in relation to that temperature. The room thermostat 80 generates a first signal after the temperature of the space to be heated falls below a predetermined minimum and generates a second signal after the temperature of the space to be heated rises above a predetermined maximum. The room thermostat 80 allows electricity to reach 70 when the temperature of the space to be heated falls below the predetermined maximum and prevents electricity from reaching 70 when the temperature in the space to be heated rises above the predetermined minimum.

In the preferred embodiment, the heating unit optionally further comprises a timing control means timer 90, electrically coupled to the heating element 50, for preventing the flow of electricity to the heating element 50 during predetermined time periods. One of the main advantages achieved by use of an ETS heating unit is that it allows heat to be generated and stored when the cost of electricity is low, and then allows the low cost stored heat to be used when the cost of electricity is high. Accordingly, it is preferred to employ a timing control means 90 to prevent the flow of electricity to the heating element 50, regardless of any other signal being generated, when the cost of electricity is high.

The heating unit 10 may be constructed to virtually any desired size and heat capacity. However, for typical uses including the space heating of homes, offices, work shops, etc., heating units having a storage chamber 25 of about 0.1 to 0.3 cubic meters and a capacity to store about 5,000 to 40,000 Kcal of heat are generally suitable.

If desired, the heat storage thermostat 60 predetermined minimum and predetermined maximum may be established by a remote thermostat such as outside temperature sensor 100 for measuring the temperature of the environment external to the space to be heated. The outside temperature sensor 100 then generates a signal in relation to the temperature of the external environment and establishes a predetermined minimum and/or predetermined maximum in inverse relation to the external temperature.

The heat sink bricks 30 employed in the heating unit 10 are preferably all substantially identical. This reduces the cost of construction as only a single configuration of brick 30 need by manufactured and employed. Preferably, the heat sink bricks 30 are sized to retain about 1,000 to 1,500 Kcals per brick 30.

Preferred materials for use as insulation 22 include MICROTHERM, a fumed amorphous silica insulating material available from Micropore Insulation Limited, TR-19, a vermiculite based block insulation material available from Thermic Refractories Inc., CERA BLANKET, a needled ceramic fiber insulating material available from Manville, CERA BOARD an inorganic bound insulating board material also available from Manville and a calcium silicate insulation block material also available from Manville.

Preferably, housing 20 can be constructed of steel or aluminized steel; the heat sink bricks 30 can be ceramic magnitite or olivine; and heating elements 50 can be tubular NICRHOME or INCOLLOY.

The room thermostat 80 and heat storage thermostat 60 may be any of the well known electrical temperature sensors and controls including the mercury switch, bi-metal thermostats typically employed in such systems.

The specification is presented to aid in a complete nonlimiting understanding of our invention. Since many variations and embodiments of the invention can be made without departing from the spirit and scope of the invention, the invention resides in the claims hereinafter appended.

We claim:

1. An electric thermal storage heating unit, comprising:

(a) an insulated housing having a bottom wall with at least one laterally extending, linear opening; the housing defining a storage chamber;

(b) a plurality of heat sink bricks configured within the storage chamber so as to form at least two ducts which extend substantially vertically above and communicate at their lower ends with said at least one laterally extending, linear opening; the ducts being interconnected so as to allow air external to the chamber to be continuously drawn into a first of said ducts through said at least one laterally extending linear opening, circulated to a second of said ducts and returned external to the chamber from said second duct through said at least one laterally extending linear opening;

(c) a first substantially planar, serpentine, electrical heating element having an upper, heat-generating, portion extending into one of said ducts and a lower, connecting portion, extending out of the storage chamber through said at least one linear opening; the upper portion of the heating element having an uppermost portion having substantially parallel upper right and an upper left sides and a lowermost portion having substantially parallel lower right and lower left sides wherein the uppermost portion is angled with respect to the lowermost portion within the plane defined by the element so as to cause the right and left sides of the lowermost portion to extend at an obtuse angle of less than 180° with respect to the corresponding right and left sides of the uppermost portion; such angling of the heating element facilitating insertion and removal of the heating element through said at least one linear opening with minimal clearance;

(d) a means for circulating air from a space to be heated through the ducts;

(e) a heat-load control means for measuring the temperature in the storage chamber; the heat load control means generating a primary signal in response to the temperature in the storage chamber falling below a predetermined minimum and generating a secondary signal in response to the temperature in the storage chamber rising above a predetermined maximum; the heat-load control means being electrically coupled to the heating element such that the heating element is operative for the generation of heat only when the heat-load control means is generating the primary signal.

2. The unit of claim 1 wherein the air circulating means is electrically operable and the unit further comprises a temperature control means for measuring the temperature of the space to be heated by the unit; the temperature control means (i) generating a first signal in response to the temperature of the space to be heated falling below a predetermined minimum and generating a second signal in response to the temperature of the space to be heated rising above a predetermined maximum, and (ii) electrically coupled to the circulating means for rendering the circulating means operative for the circulation of air only in response to the temperature control means generating the first signal.

3. The unit of claim 2 wherein the temperature control means comprises a thermostat.

4. The unit of claim 3 wherein the temperature control means predetermined minimum and predetermined maximum may be readily altered by a user of the unit.

5. The unit of claim 1 further comprising a timing control means, electrically coupled to the heating element, for preventing the flow of electricity to the heating element during predetermined time periods.

6. The unit of claim 1 wherein the heat sink bricks configured within the storage chamber can retain up to about 40,000 Kcal.

7. The unit of claim 1 wherein the housing is insulated to a thermal conductivity of less than about 150 cal/(hr)(m)(°C.).

8. The unit of claim 1 wherein the storage chamber has a volume of about 0.1 to 0.3 $m^3$.

9. The unit of claim 8 wherein all of the heat sink bricks are substantially identical and about 10 to 100 bricks are configured within the storage chamber.

10. The unit of claim 9 wherein the bricks are substantially rectangular and have a substantially linear channel along the entire length of a first face thereof; the channels in the bricks forming the ducts.

11. The unit of claim 1 wherein the air circulating means is a fan.

12. The unit of claim 1 wherein the heat-load control means comprises a thermostat.

13. The unit of claim 12 wherein the heat-load control means predetermined minimum and predetermined maximum are established manually by a user of the unit.

14. The unit of claim 12 wherein the heat-load control means predetermined minimum and predetermined maximum are established by a remote thermostat for measuring the temperature of the environment external to the space to be heated; the remote thermostat generating a signal in relation to the temperature of the external environment and electrically coupled to the heat-load control means so as to establish the predetermined minimum and predetermined maximum in inverse relation to the external temperature.

15. An electric thermal storage heating unit, comprising:

(a) an insulated housing having a bottom wall with at least a pair of laterally extending, linear openings; the housing defining a storage chamber;

(b) a plurality of heat sink bricks configured within the storage chamber so as to form at least two pair of ducts which extend substantially vertically above and communicate at their lower ends with the pair of laterally extending, linear openings; the pair of ducts being interconnected so as to allow air external to the chamber to be continuously drawn into one of the pair of ducts through one of the pair of laterally extending linear openings, circulated from the first duct to the other of the pair of ducts and returned external to the chamber through the other of the pair of laterally extending linear openings;

(c) a substantially planar, serpentine, electrical heating element having an upper, heat-generating, portion extending into one of the pair of ducts and a lower, connecting portion extending out of the storage chamber through one of the pair of linear openings; the upper portion of the heating element having an uppermost portion having substantially parallel upper right and an upper left sides and a lowermost portion having substantially parallel lower right and lower left sides wherein the uppermost portion is angled with respect to the lowermost portion within the plane defined by the element so as to cause the right and left sides of the lower most portion to extend at an obtuse angle of less than 180° with respect to the corresponding right and left sides of the uppermost portion; such angling of the heating element facilitating insertion and removal of the heating element through said at least one linear opening with minimal clearance;

(d) a means for circulating air from a space to be heated through the ducts;

(e) a heat-load control means for measuring the temperature in the storage chamber; the heat load control means generating a primary signal in response to the temperature in the storage chamber falling below a predetermined minimum and generating a secondary signal in response to the temperature in the storage chamber rising above a predetermined maximum; the heat-load control means being electrically coupled to the heating element such that the heating element is operative for the generation of heat only when the heat-load control means is generating the primary signal.

16. The unit of claim 15 wherein said first and second linear openings are substantially parallel.

17. The unit of claim 16 wherein (i) the bricks are substantially rectangular and have a substantially linear channel along the entire length of a first face thereof; the channel in the bricks forming the ducts, and (ii) the ducts extend substantially vertically from the laterally extending linear openings and are coupled at the top by a longitudinal duct connecting each vertical duct extending from one of the linear openings with the vertical duct extending from the other linear opening.

18. The unit of claim 16 further comprising a second electrical heating element configured substantially identical to the first heating element with the first heating element extending into one of the pair of ducts through one of the pair of linear openings, the second heating element extending into the other of the pair of ducts through the other of the pair of linear openings, and the first and second heating elements coupled by a coupling element located outside the storage chamber.

* * * * *

UNITED STATES PATENT AND TRADEMARK OFFICE

CERTIFICATE OF CORRECTION

PATENT NO. : 5,042,081

DATED : August 20, 1991

INVENTOR(S) : Paul J. Steffes et al.

It is certified that error appears in the above-identified patent and that said Letters Patent is hereby corrected as shown below:

On the title page, item (54) line 3, and in column 1, line 2, please add the word -- ELEMENTS -- at the end of the title.

Under Related U.S. Application Data, Item 63,
Please delete "Nov. 24, 1989" and substitute therefore
--Nov. 24, 1987--.

UNITED STATES PATENT AND TRADEMARK OFFICE

CERTIFICATE OF CORRECTION

PATENT NO. : 5,042,081

DATED : August 20, 1991

INVENTOR(S) : Paul J. Steffes et al.

It is certified that error appears in the above-identified patent and that said Letters Patent is hereby corrected as shown below:

In Column 2, line 42,
please delete "a" after the word "opening".

In Column 2, line 58,
please delete "in" after the word "of".

In Column 3, line 57,
please delete "by a portion 50C" after the word "connected".

In Column 4, line 37,
please insert the word --fans-- after the word "of".

In Column 4, line 40,
please insert the word --fans-- after the word "the".

In Column 4, line 46,
please insert the word --fans-- after the word "reach".

UNITED STATES PATENT AND TRADEMARK OFFICE

CERTIFICATE OF CORRECTION

PATENT NO. : 5,042,081

DATED : August 20, 1991

INVENTOR(S) : Paul J. Steffes et al.

It is certified that error appears in the above-identified patent and that said Letters Patent is hereby corrected as shown below:

In Column 4, line 49,
please insert the word --fans-- after the word "reaching".

In Column 4, line 52,
Please insert --such as a-- after the word "means".

In Column 4, lines 60-61,
please delete "timing control means" and substitute therefore --timer--.

In Column 5, line 32,
please delete "NICRHOME or INCOLLOY" and substitute therefore --NICHROME or INCOLOY--.

In Column 5, line 36,
please delete "thermostats" and substitute therefore --thermometers--.

In Column 5, Claim 1, line 58,
please insert --through the ducts-- after the word "circulated".

In Column 5, Claim 1, line 64,
please insert the word --the-- after the word "into".

Signed and Sealed this

Sixth Day of July, 1993

*Attest:*

Michael K. Kirk

MICHAEL K. KIRK

*Attesting Officer*

*Acting Commissioner of Patents and Trademarks*